US010630007B2

(12) United States Patent
Kishibata et al.

(10) Patent No.: US 10,630,007 B2
(45) Date of Patent: Apr. 21, 2020

(54) PRESS-FIT TERMINAL AND PRESS-FIT TERMINAL CONNECTION STRUCTURE OF CIRCUIT BOARD

(71) Applicant: YAZAKI CORPORATION, Tokyo (JP)

(72) Inventors: Yuya Kishibata, Shizuoka (JP); Takayuki Kato, Shizuoka (JP); Takahiro Yudate, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/176,003

(22) Filed: Oct. 31, 2018

(65) Prior Publication Data

US 2019/0131727 A1 May 2, 2019

(30) Foreign Application Priority Data

Nov. 1, 2017 (JP) ..... 2017-211900

(51) Int. Cl.
*H01R 12/58* (2011.01)
*H01R 12/71* (2011.01)

(52) U.S. Cl.
CPC ..... *H01R 12/585* (2013.01); *H01R 12/716* (2013.01)

(58) Field of Classification Search
CPC ..... H01R 12/585
USPC ..... 439/751, 82
See application file for complete search history.

(56) References Cited

U.S. PATENT DOCUMENTS 4,769,907 A * 9/1988 Sebastien ..... H01R 12/585 29/874
4,793,817 A * 12/1988 Hiesbock ..... H01R 12/585 439/751
4,828,514 A * 5/1989 Johnson ..... H01R 12/585 439/751
4,857,018 A * 8/1989 Pickles ..... H01R 12/585 439/751
4,923,414 A * 5/1990 Sitzler ..... H01R 12/585 439/751
5,564,954 A * 10/1996 Wurster ..... H01R 12/585 439/751
5,664,970 A * 9/1997 Millhimes ..... H01R 12/585 439/751

(Continued)

FOREIGN PATENT DOCUMENTS

JP 4030129 B2 1/2008

*Primary Examiner* — Ross N Gushi
(74) *Attorney, Agent, or Firm* — Metrolex IP Law Group, PLLC

(57) ABSTRACT

The press-fit terminal includes: a press-fit portion that is deformed in a width direction orthogonal to a press-fit direction into a through hole of a circuit board when the press-fit portion is press-fitted into the through hole; a slit that is formed in the press-fit portion and has a longitudinal direction matched with the press-fit direction into the through hole; and a contact portion, which is formed in a part on an imaginary line passing through a center of the slit in the longitudinal direction and extending in the width direction in the press-fit portion and comes into contact with an inner wall of the through hole by press-fitting the press-fit portion into the through hole. The shortest distance from the contour of the press-fit portion to the slit becomes largest in the contact portion.

6 Claims, 11 Drawing Sheets

(56) References Cited

U.S. PATENT DOCUMENTS 5,944,538 A * 8/1999 Sorig ..... H01R 12/585 439/82
6,077,128 A * 6/2000 Maag ..... H01R 12/585 439/751
6,213,817 B1 * 4/2001 Jeong ..... H01R 12/585 439/751
6,483,041 B1 * 11/2002 Downes ..... H01R 12/585 174/260
6,800,545 B2 * 10/2004 Downes ..... H01R 12/585 438/612
7,008,272 B2 * 3/2006 Blossfeld ..... H01R 12/585 439/751
7,083,434 B1 * 8/2006 Blossfeld ..... H01R 12/585 200/284
7,240,427 B2 * 7/2007 Ocket ..... H01R 12/585 29/844
7,344,389 B2 * 3/2008 Kramski ..... H01R 12/585 439/82
7,377,823 B2 * 5/2008 Chen ..... H01R 12/585 439/751
7,465,198 B2 * 12/2008 Su ..... H01R 13/111 439/733.1
7,488,219 B2 * 2/2009 Matsumura ..... H01R 12/585 439/751
7,491,897 B2 * 2/2009 Watanabe ..... H01R 12/585 174/266
7,591,655 B2 * 9/2009 Fedder ..... H01R 12/585 439/108
7,670,196 B2 * 3/2010 Fedder ..... H01R 12/585 439/751
7,780,483 B1 * 8/2010 Ravlich ..... H01R 12/585 439/751
7,922,545 B2 * 4/2011 Saitoh ..... H01R 12/585 439/751
8,002,559 B2 * 8/2011 Thiel ..... H01R 12/585 439/751
8,092,262 B1 * 1/2012 Frederick ..... H01R 12/585 439/751
8,313,344 B2 * 11/2012 Johnescu ..... H01R 12/585 439/571
8,747,124 B2 * 6/2014 Trout ..... H01R 4/26 439/751
8,771,028 B2 * 7/2014 Tonosaki ..... H01R 13/03 439/151
8,992,235 B2 * 3/2015 Kataoka ..... H01R 12/585 439/751
9,083,091 B1 * 7/2015 Ravlich ..... H01R 4/2425
9,093,780 B2 * 7/2015 Miyake ..... H01R 12/585
9,276,338 B1 * 3/2016 Dariavach ..... H01R 12/585
9,356,367 B2 * 5/2016 Vino, IV ..... H01R 43/16
9,431,733 B1 * 8/2016 Heistand ..... H01R 43/16
9,685,719 B2 * 6/2017 Uchida ..... H01R 12/585
9,743,531 B2 * 8/2017 Miyake ..... H05K 1/115
9,831,607 B2 * 11/2017 Laurx ..... H01R 12/585
9,979,105 B2 * 5/2018 Egusa ..... H01R 12/585
10,027,048 B2 * 7/2018 Ochi ..... H01R 12/585
10,096,917 B1 * 10/2018 Myer ..... H01R 12/585
10,230,184 B1 * 3/2019 Myer ..... H01R 12/585
10,236,603 B2 * 3/2019 Goto ..... H01R 43/16
10,276,955 B2 * 4/2019 Lybrand ..... H01R 9/2416
2004/0145880 A1 * 7/2004 Watanabe ..... H01R 12/585 361/803
2004/0203293 A1 * 10/2004 Hu ..... H01R 12/585 439/751
2004/0242033 A1 * 12/2004 Hu ..... H01R 12/585 439/82
2005/0003704 A1 * 1/2005 Kasahara ..... H01R 12/707 439/567
2005/0090155 A1 * 4/2005 Blossfeld ..... H01R 12/585 439/751
2005/0181651 A1 * 8/2005 Matsumura ..... H01R 12/585 439/259
2005/0250356 A1 * 11/2005 Matsumura ..... H01R 12/585 439/82
2007/0212907 A1 * 9/2007 Kramski ..... H01R 12/585 439/82
2008/0166928 A1 * 7/2008 Tang ..... H01R 12/585 439/751
2008/0318453 A1 * 12/2008 Dancison ..... H01R 12/585 439/82
2009/0104823 A1 * 4/2009 Ludwig ..... H01R 12/585 439/857
2009/0239398 A1 * 9/2009 Lynch ..... H01R 12/585 439/81
2012/0289102 A1 * 11/2012 Moll ..... H01R 12/585 439/890
2013/0034976 A1 * 2/2013 Tonosaki ..... H01R 12/585 439/84
2013/0165001 A1 * 6/2013 Kataoka ..... H01R 13/05 439/889
2014/0213080 A1 * 7/2014 Miyake ..... H01R 12/585 439/82
2014/0342619 A1 * 11/2014 Uchida ..... H01R 12/585 439/751
2018/0233839 A1 * 8/2018 Kishibata ..... H01R 12/585
2019/0014660 A1 * 1/2019 Brammer ..... H05K 1/0281

* cited by examiner

PRESS-FIT TERMINAL AND PRESS-FIT TERMINAL CONNECTION STRUCTURE OF CIRCUIT BOARD

CROSS REFERENCE TO RELATED APPLICATION

The present application is based on, and claims priority from Japanese Patent Application No. 2017-211900, filed Nov. 1, 2017, the disclosure of which is hereby incorporated by reference herein in its entirety.

TECHNICAL FIELD

The present application relates to a press-fit terminal, which is press-fitted into a through hole of a circuit board so that electrical connection with the through hole is established by contact pressure.

BACKGROUND ART

A press-fit terminal is press-fitted into a through hole of a circuit board so that electrical connection with the through hole is established by contact pressure. That is, soldering is not required for electrical connection between the press-fit terminal and the circuit board.

For this reason, a press-fit terminal has attracted attention as a contributor to simplification of processes for mounting a component such as a connector having a terminal on a circuit board, achievement of a lead-free state, or miniaturization of terminal arrangement on a circuit board by shortening the distance between the terminals.

For these reasons, it is important for a press-fit terminal to realize reliable electrical connection with a through hole of a substrate and obtain retention stability by a circuit board when press-fitted into the through hole.

Proposals to improve the retention stability of a press-fit terminal press-fitted into a through hole are also applied to a press-fit terminal in the form of a needle eye in which a slit facilitating deformation of the press-fit terminal in the through hole is formed in the press-fit portion.

In one of press-fit terminals in the form of a needle eye of a conventional example according to such proposals, the intermediate position of the slit in the press-fit direction of the press-fit terminal with respect to the through hole is displaced to the tip side of the press-fit terminal in comparison with the position where the width of the press-fit portion having a larger width than the hole diameter of the through hole becomes largest (see JP 4030129 B2).

In the press-fit terminal of the conventional example, the width between the contour of the press-fit portion and the slit is narrowed on the tip side of the press-fit terminal and widened on the base side by displacing the slit of the press-fit portion to the tip side of the press-fit terminal.

For this reason, on the tip side of the press-fit terminal where the width between the contour of the press-fit portion and the slit is narrowed, the rigidity of the press-fit portion is lowered, deformation toward the slit is facilitated, and it is possible to reduce the insertion force of the press-fit terminal for press-fitting the press-fit terminal into the through hole.

On the other hand, on the base side of the press-fit terminal where the width between the contour of the press-fit portion and the slit is widened, the rigidity of the press-fit portion is raised to lower the possibility of deformation toward the slit, and the possibility that the press-fit terminal buckles when press-fitting the press-fit terminal into the through hole, and it is possible to retain the press-fit terminal press-fitted into the through hole stably on the circuit board.

SUMMARY

In a press-fit terminal of a conventional example, the base side of the press-fit terminal where the possibility of deformation toward the slit is low has a higher contact pressure against the inner wall of the through hole when press-fitting the press-fit terminal into the through hole than the tip side of the press-fit terminal where the possibility of deformation toward the slit is high. For this reason, for press-fitting a press-fit terminal into a through hole, it is advantageous to press-fit the press-fit terminal deeply into the through hole to the base side in order to ensure the electrical connection therebetween.

In other words, in order to obtain a stable retention state where the press-fit terminal of the conventional example is press-fitted into the through hole to ensure the electrical connection therebetween, it is necessary that the press-fit terminal is press-fitted into the through hole to an enough depth to put the base side of the press-fit terminal into contact with the inner wall of the through hole.

Accordingly, in the press-fit terminal of the conventional example, a state where the base side of the press-fit terminal comes into contact with the inner wall of the through hole and the press-fit terminal is stably retained in the through hole is not realized if the press-fit depth with respect to the through hole is insufficient. If the press-fit terminal is not stably retained in the through hole, realization of reliable electrical connection between the press-fit terminal and the through hole becomes uncertain.

The present application has been made in view of such circumstances, and an object of the present application is to provide: a press-fit terminal capable of realizing reliable electrical connection with a through hole by obtaining a stable retention state even if the press-fit depth with respect to a through hole of a circuit board varies; and a press-fit terminal connection structure of a circuit board.

To achieve the above object, a press-fit terminal according to a first aspect of the present application includes: a press-fit portion that is deformed in a width direction orthogonal to a press-fit direction into a through hole of a circuit board when the press-fit portion is press-fitted into the through hole; a slit that is formed in the press-fit portion and has a longitudinal direction matched with the press-fit direction into the through hole; and a contact portion, which is formed in a part on an imaginary line passing through the center of the slit in the longitudinal direction and extending in the width direction in the press-fit portion and comes into contact with an inner wall of the through hole by press-fitting the press-fit portion into the through hole, the shortest distance from the contour of the press-fit portion to the slit becoming largest in the contact portion.

With such a structure, the part of the press-fit portion where the slit is formed can be deformed toward the center in the width direction of the slit due to presence of the slit. For this reason, when the press-fit portion is press-fitted into the through hole of the circuit board, the press-fit portion is press-fitted into the through hole to a depth such that the part of the press-fit portion which can be deformed due to formation of the slit is positioned in the through hole.

When the press-fit portion is press-fitted into the through hole of the circuit board, stress in the width direction orthogonal to the press-fit direction is applied from the inner wall of the through hole to the press-fit portion by press fitting. Then, due to the stress applied to the press-fit portion from the inner wall of the through hole, the part of the press-fit portion where the slit is formed is deformed toward the center of the width direction of the slit.

At this time, the stress applied from the inner wall of the through hole to the press-fit portion press-fitted into the through hole of the circuit board acts and concentrates on a part of the press-fit portion where the rigidity is lowest.

The rigidity of the press-fit portion becomes highest in the contact portion where the shortest distance from the contour of the press-fit portion to the slit becomes largest. Accordingly, in the press-fit portion press-fitted into the through hole, the possibility of deformation toward the inner side of the slit becomes lowest in the vicinity of the contact portion to come into contact with the inner wall of the through hole.

For this reason, the press-fit portion press-fitted into the through hole has a structure such that the contact portion can easily maintain the shape protruded most outward in the width direction even if the press-fit portion is deformed in the width direction. Hence, even if the press-fit portion is deformed by press-fitting into the through hole, the contact portion of the press-fit portion reliably comes into contact with the inner wall of the through hole.

In addition, when the press-fit portion is press-fitted into the through hole to a depth such that the part of the press-fit portion where the slit is formed is positioned within the through hole, the contact portion of the press-fit portion which is positioned on an imaginary line in the width direction passing through the center in the longitudinal direction of the slit comes into contact with the inner wall of the through hole in the vicinity of the center of the through hole in the press-fit direction.

For this reason, even if the press-fit depth of the press-fit portion with respect to the through hole of the circuit board varies, the position of the contact portion of the press-fit portion to come into contact with the inner wall of the through hole is only displaced slightly to one of a shallower position and a deeper position interposing the center of the through hole in the press-fit direction and is not displaced to a position outside the through hole.

Hence, even if the press-fit depth of the press-fit portion with respect to the through hole of the circuit board varies, it is possible to reliably cause the press-fit portion to come into contact with the inner wall of the through hole, to obtain a state where the press-fit portion is stably retained in the through hole, and to realize reliable electrical connection between the press-fit portion and the through hole.

The contact portion may be formed in a shape such that a difference obtained by subtracting the hole diameter of the through hole from the dimension in the width direction of the press-fit portion before being press-fitting into the through hole becomes the maximum deformed amount in the width direction toward the slit of the press-fit portion by press-fitting the press-fit portion into the through hole.

With such a structure, it is possible to cause the contact portion of the press-fit portion protruded outward in the width direction in comparison with the other part of the press-fit portion to reliably come into contact with the inner wall of the through hole even if the press-fit portion is deformed by press-fitting the press-fit portion into the through hole.

The press-fit portion may be formed with a contour such that the shortest distance to the slit becomes smallest at both ends in the longitudinal direction of the slit.

With such a structure, the stress applied from the inner wall of the through hole to the contact portion of the press-fit portion press-fitted into the through hole of the circuit board concentrates and acts on a part of the press-fit portion where the rigidity is lowest.

The rigidity of the press-fit portion is lowest at both end parts in the longitudinal direction of the slit where the shortest distance from the contour of the press-fit portion to the slit becomes smallest. Accordingly, the press-fit portion press-fitted into the through hole starts to deform toward the inner side of the slit from the vicinity of both ends in the longitudinal direction of the slit, which are furthest in the press-fit direction from the contact portion to come into contact with the inner wall of the through hole.

For this reason, by forming the press-fit portion press-fitted into the through hole in a structure such that the contact portion is easily deformed into a shape protruded most outward in the width direction, it is possible to cause the contact portion of the press-fit portion deformed in the through hole to reliably come into contact with the inner wall of the through hole.

The press-fit portion may be formed with a contour such that the dimension in the width direction becomes largest in the contact portion.

Since the press-fit portion is formed with a contour such that the dimension in the width direction becomes largest in the contact portion, the press-fit portion press-fitted into the through hole of the circuit board comes into contact with the inner wall of the through hole most reliably in the contact portion.

For this reason, even if the press-fit depth of the press-fit portion with respect to the through hole of the circuit board varies, it is possible to reliably realize a structure in which the press-fit portion is stably retained in the through hole and the both are electrically connected with each other.

The press-fit terminal may include a linear portion, which is formed in a part of the press-fit portion continuous to the contact portion in the press-fit direction and has a dimension in the width direction linearly decreasing with the larger distance from the imaginary line in the press-fit direction, and the contact portion may be formed with a convex circular arc contour on a side away from the slit.

By forming the contact portion with a circular arc contour, the sliding resistance between the press-fit portion and the inner wall of the through hole can be reduced.

On the other hand, by forming the linear portion continuous with the contact portion in a structure such that the rigidity is lowered with the larger distance in the press-fit direction from the contact portion, it is possible to easily realize a press-fit portion having a structure in which the contact portion is easily deformed into a shape protruded most outward in the width direction when press-fitted into the through hole.

A press-fit terminal connection structure of a circuit board according to a second aspect of the present application includes a circuit board having a through hole formed therein, and a press-fit terminal press-fitted into the through hole. The press-fit includes: a press-fit portion, which is press-fitted into the through hole and is deformed in a width direction orthogonal to a press-fit direction to the through hole; a slit, which is formed in the press-fit portion and has a longitudinal direction matched with the press-fit direction to the through hole; and a contact portion, which is formed in a part on an imaginary line passing through the center of the slit in the longitudinal direction and extending in the width direction in the press-fit portion, and comes into contact with the inner wall of the through hole. The shortest distance from the contour of the press-fit portion to the slit becomes largest in the contact portion.

Since a part of the press-fit portion where the slit is formed can be deformed toward the center in the width direction of the slit due to presence of the slit, a part of the press-fit portion where the slit is deformed in the press-fit portion press-fitted into the through hole of the circuit board is positioned inside the through hole.

Stress in the width direction orthogonal to the press-fit direction is applied from the inner wall of the through hole to the press-fit portion press-fitted into the through hole of the circuit board, and the part of the press-fit portion where the slit is formed is deformed toward the center in the width direction of the slit by the stress. At this time, the stress applied to the press-fit portion concentrates and acts on a part of the press-fit portion where the rigidity is lowest.

The rigidity of the press-fit portion becomes highest in the contact portion where the shortest distance from the contour of the press-fit portion to the slit becomes largest. Accordingly, in the press-fit portion press-fitted into the through hole, the possibility of deformation toward the inner side of the slit becomes lowest in the vicinity of the contact portion to come into contact with the inner wall of the through hole.

For this reason, the press-fit portion press-fitted into the through hole has a structure such that the contact portion can easily maintain the shape protruded most outward in the width direction even if the press-fit portion is deformed in the width direction. Hence, the contact portion of the press-fit portion deformed by press-fitting into the through hole reliably comes into contact with the inner wall of the through hole.

In addition, the contact portion of the press-fit portion press-fitted into the through hole to a depth such that the part of the press-fit portion where the slit is formed is positioned inside the through hole is positioned on an imaginary line in the width direction passing through the center in the longitudinal direction of the slit and therefore comes into contact with the inner wall of the through hole in the vicinity of the center of the through hole in the press-fit direction.

For this reason, even if the press-fit depth of the press-fit portion with respect to the through hole of the circuit board varies, the position of the contact portion of the press-fit portion in contact with the inner wall of the through hole is only slightly displaced to one of a shallower position and a deeper position interposing the center of the through hole in the press-fit direction and is not displaced to a position outside the through hole.

Hence, even if the press-fit depth of the press-fit portion with respect to the through hole of the circuit board varies, it is possible to reliably cause the press-fit portion to come into contact with the inner wall of the through hole, to obtain a state where the press-fit portion is stably retained in the through hole, and to realize reliable electrical connection between the press-fit portion and the through hole.

With the press-fit terminal according to the first aspect of the present application and the press-fit terminal connection structure of a circuit board according to the second aspect of the present application, it is possible to obtain a stable retention state and realize reliable electrical connection with the through hole even if the press-fit depth with respect to the through hole of the circuit board varies.

DESCRIPTION OF EMBODIMENTS

The following description will explain an embodiment with reference to the drawings.

Figure 1:
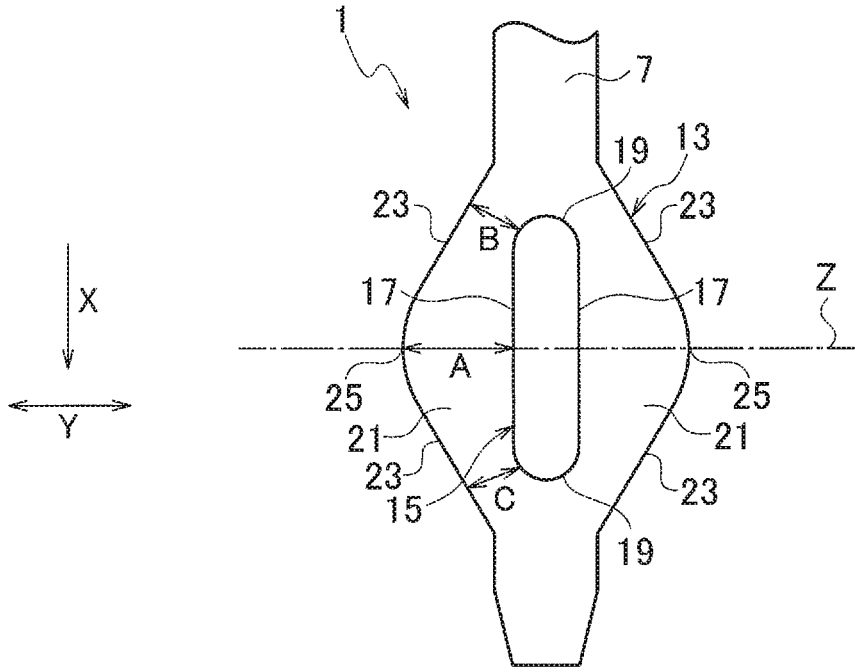
FIG. 1 is an explanatory drawing illustrating a principal part of a press-fit terminal according to an embodiment.
Figure 2:
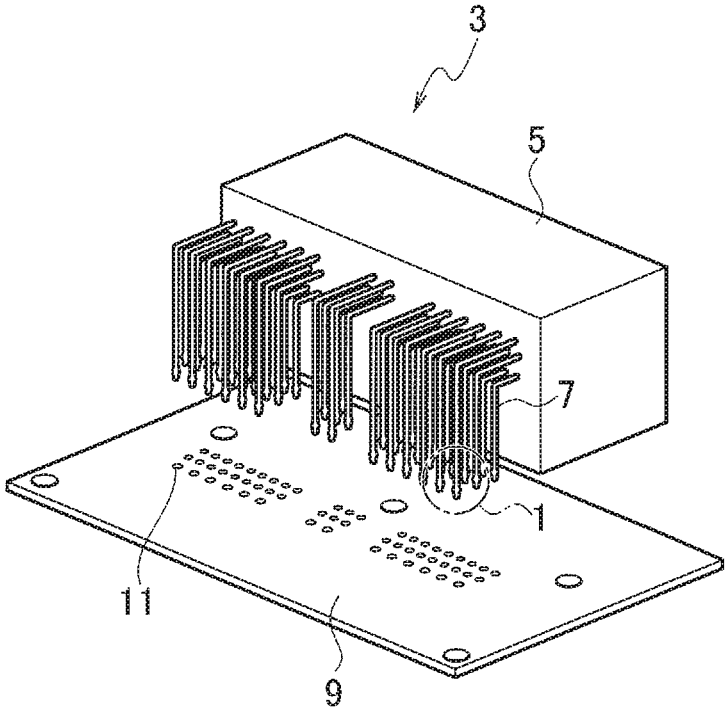
FIG. 2 is a perspective view illustrating an example of the usage state of a press-fit terminal according to the embodiment.

A press-fit terminal 1 according to an embodiment as illustrated in FIG. 1 is applied to, for example, a tip part of a terminal pin 7 led out of a housing 5 of a connector 3 as illustrated in FIG. 2. Then, the press-fit terminal 1 is press-fitted into a through hole 11 of a circuit board 9 on which the connector 3 is mounted.

The press-fit terminal 1 according to the embodiment is provided in the vicinity of the tip of the terminal pin 7, and includes a press-fit portion 13 to be press-fitted into the through hole 11 of the circuit board 9. The press-fit portion 13 has a flat thin plate shape along the paper surface direction of FIG. 1. At the center of the press-fit portion 13 in the width direction Y orthogonal to the press-fit direction X into the through hole 11, a slit 15 having a longitudinal direction matched with the press-fit direction X is formed.

The slit 15 is provided in two linear portions 17 extending in parallel and at intervals in the width direction Y, and two semicircular portions 19 connecting the two linear portions 17 at both ends in the longitudinal direction (press-fit direction X), and is formed in a long hole shape. The slit 15 provides a space enabling deformation in the width direction Y of the press-fit portion 13 press-fitted into the through hole 11 of the circuit board 9.

The press-fit portion 13 includes swelling portions 21 protruded outward in each width direction Y from the contour of the terminal pin 7. The contour of each of the swelling portions 21 includes two linear portions 23 and a contact portion 25 between the two linear portions 23.

Each of the linear portions 23 is inclined with respect to the slit 15 so as to get close in the width direction Y from the linear portion 17 of the slit 15 with the larger distance in the press-fit direction X from an imaginary line Z, which passes through the center in the longitudinal direction (press-fit direction X) of the slit 15 and extends in the width direction Y. Each contact portion 25 is formed of a convex circular arc on a side away in the width direction Y from each linear portion 17 of the slit 15. The center of curvature of each contact portion 25 is positioned on the imaginary line Z.

Accordingly, the press-fit portion 13 has a shape such that the dimension in the width direction Y linearly decreases with the larger distance in the press-fit direction X from the imaginary line Z in the part of the linear portion 23 of the swelling portion 21. Also, the press-fit portion 13 is formed with a contour such that the shortest distances B and C to the slit 15 become the minimum dimension (B=C) in the part of the linear portions 23 positioned on both end sides of the slit 15 in the press-fit direction X.

Moreover, the press-fit portion 13 is formed with a contour such that the dimension in the width direction Y becomes largest in the part of the contact portion 25 of the swelling portion 21. Also, the press-fit portion 13 is formed with a contour such that the shortest distance A to the slit 15 becomes the maximum dimension larger than the hole diameter of the through hole 11 of the circuit board 9 in the part of the contact portion 25.

The contact portion 25 of the press-fit portion 13 is formed in a shape such that a difference obtained by subtracting the hole diameter of the through hole 11 from the dimension of the press-fit portion 13 in the width direction Y before press-fitting into the through hole 11 becomes the maximum deformed amount in the width direction Y toward the slit 15 of the press-fit portion 13 caused by press-fitting into the through hole 11.

Since the contact portion 25 in which the dimension in the width direction Y of the press-fit portion 13 becomes largest is larger than the hole diameter of the through hole 11, the press-fit portion 13 is deformed toward the slit 15 when the press-fit portion 13 is inserted into the through hole 11 of the circuit board 9, and the press-fit portion 13 is press-fitted into the through hole 11.

Figure 3A:
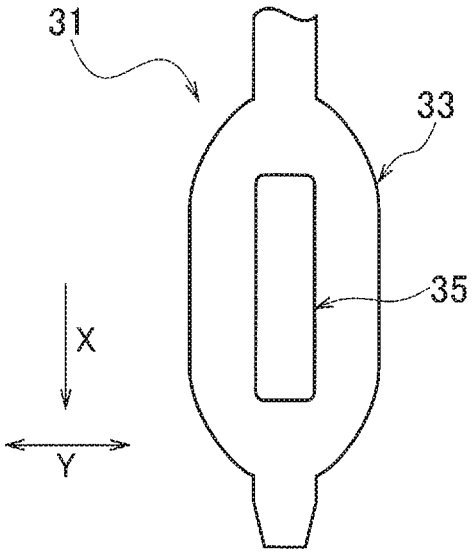
FIG. 3A PRIOR ART
FIG. 3A is an explanatory drawing illustrating a principal part of a press-fit terminal according to a comparative example.
Figure 3B:
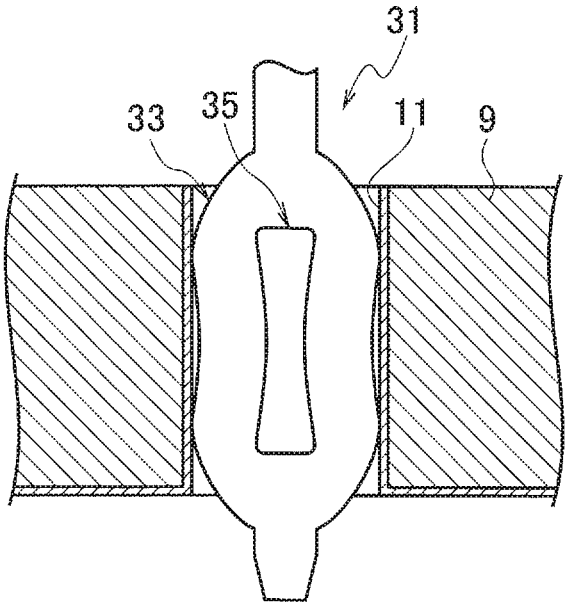
FIG. 3B PRIOR ART
FIG. 3B is an explanatory drawing conceptually illustrating a state of contact with a through hole when press-fitting the press-fit terminal according to the comparative example into a through hole of a circuit board.

Here, as with a press-fit terminal 31 according to a comparative example as illustrated in FIG. 3A, a center part in a press-fit direction X of a press-fit portion 33 press-fitted into the through hole 11 is deformed most toward a slit 35 as illustrated in FIG. 3B in a case where the dimensions of the press-fit portion 33 and the slit 35 in a width direction Y are substantially constant and linear in the press-fit direction X.

That is, the press-fit portion 33 press-fitted into the through hole 11 is deformed toward the slit 35 by the stress applied from the inner wall of the through hole 11. At this time, the press-fit portion 33 is deformed most toward the slit 35 in parts in the vicinity of both ends where the shortest distance from the contour of the press-fit portion 33 to the slit 15 is smaller than the center part of the slit 35 in the press-fit direction X and the rigidity is low.

Then, since the press-fit portion 33 has a linear contour in the press-fit direction X, the center part of the slit 35 in the press-fit direction X of the press-fit portion 33 is deformed most toward the slit 35 when the press-fit portion 33 is deformed toward the slit 15 in parts in the vicinity of both ends of the slit 35 in the press-fit direction X.

For this reason, when the press-fit portion 33 in the press-fit terminal 31 according to the comparative example is press-fitted into the through hole 11, parts in the vicinity of both ends of the slit 35 in the press-fit direction X of the press-fit portion 33 come into contact with the inner wall of the through hole 11, and the center part of the slit 35 in the press-fit direction X of the press-fit portion 33 is spaced apart in the width direction Y from the inner wall of the through hole 11.

Accordingly, in the press-fit terminal 31 according to the comparative example, the press-fit portion 33 is retained in the through hole 11 at parts in the vicinity of both ends of the slit 35 in the press-fit direction X of the press-fit portion 33, so that the both are electrically connected with each other.

Hence, when excess or deficiency occurs in the press-fit depth of the press-fit portion 33 with respect to the through hole 11 in the press-fit terminal 31 according to the comparative example, parts in the vicinity of both ends of the slit 35 in the press-fit direction X of the press-fit portion 33 are arranged outside the through hole 11 in the press-fit direction X and do not come into contact with the inner wall of the through hole 11.

Then, the retention state of the press-fit portion 33 in the through hole 11 becomes unstable, and the reliability of electrical connection between the press-fit portion 33 and the through hole 11 deteriorates.

For this reason, in the press-fit terminal 1 according to the embodiment, the press-fit portion before press-fitted into the through hole 11 and deformed is swelled outward in the width direction Y so that the dimension in the width direction Y becomes largest in the center part of the slit in the press-fit direction X.

Figure 4:
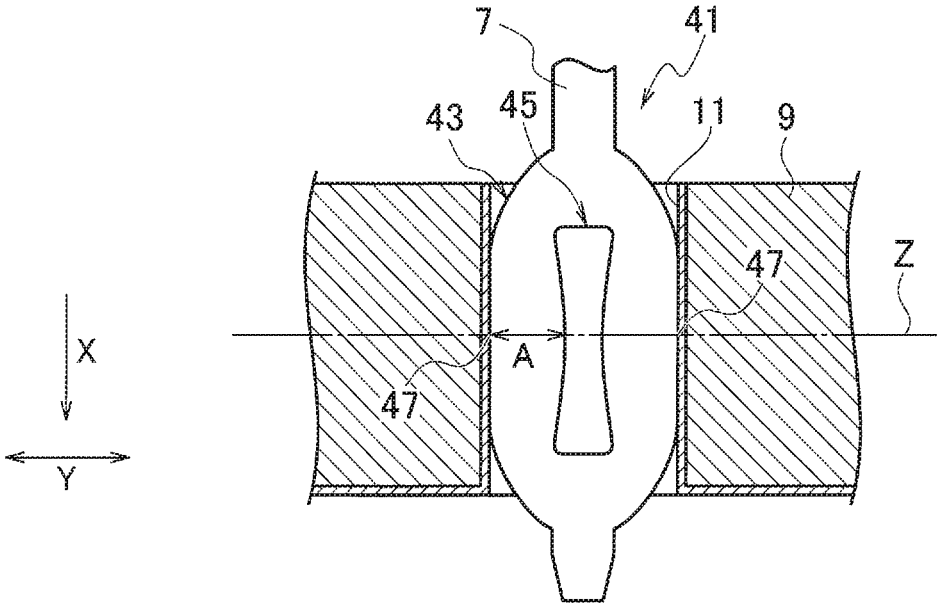
FIG. 4 is an explanatory drawing illustrating a press-fit terminal connection structure of a circuit board according to the embodiment.

In such a manner, as with the connection structure of a press-fit terminal 41 according to the embodiment as illustrated in FIG. 4 into the through hole 11 of the circuit board 9, the center part of the slit 45 in the press-fit direction X of the press-fit portion 43 press-fitted into the through hole 11 comes into contact with the inner wall of the through hole 11 even when the part is deformed most toward the slit 45 by press-fitting.

Then, the outer edge of the press-fit portion 43 comes into contact with the inner wall of the through hole 11 in a certain length part continuous in the press-fit direction X. The outer edge part of the press-fit portion 43 to come into contact with the inner wall of the through hole 11 includes: contact portions 47 on the imaginary line Z passing through the center of the slit 45 in the press-fit direction X; and parts that interpose the contact portion 47 therebetween and are respectively continuous with both end sides of the slit 45 in the press-fit direction X.

In the press-fit terminal 41 according to the embodiment as illustrated in FIG. 4, the contact portion 47 is included in the outer edge part of the press-fit portion 43 to come into contact with the inner wall of the through hole 11 because the dimension of the contact portion 47 in the width direction Y of the press-fit portion 43 before insertion into the through hole 11 is set to a dimension obtained by adding the maximum deformed amount of the contact portion 47 in the width direction Y and the hole diameter of the through hole 11.

That is, by setting the dimension of the contact portion 47 in the width direction Y of the press-fit portion 43 before insertion into the through hole 11 to the above-described dimension, it is possible to cause the contact portion 47 to never fail to come into contact with the inner wall of the through hole 11 even when the press-fit portion 43 is deformed in the width direction Y by press-fitting into the through hole 11.

Therefore, in the press-fit terminal 1 according to the embodiment as illustrated in FIG. 1, the press-fit portion 13 has the swelling portions 21 on both sides in the width direction Y. In addition, the press-fit portion 13 is formed to have a width larger than the hole diameter of the through hole 11 of the circuit board 9, and a contour shape such that the dimension in the width direction Y of the press-fit portion 13 becomes largest in the contact portion 25 on the imaginary line Z passing through the center of the slit 15 in the press-fit direction X.

Moreover, the press-fit portion 13 is formed with a contour such that the shortest distances B and C to the slit 15 become the minimum dimensions in the part of the linear portion 23 of the swelling portion 21 positioned at both ends of the slit 15 in the press-fit direction X, and the shortest distance A to the slit 15 becomes the maximum dimension larger than the hole diameter of the through hole 11 of the circuit board 9 in the part of the contact portion 25 of the swelling portion 21 positioned at the center of the slit 15 in the press-fit direction X.

For this reason, the rigidity of the press-fit portion 13 is made highest in the contact portion 25 where the shortest distance A from the contour of the press-fit portion 13 to the slit 15 becomes largest, so that the possibility of deformation of the press-fit terminal 1 toward the inner side of the slit 15 becomes lowest in the vicinity of the contact portion 25 of the press-fit portion 13 press-fitted into the through hole 11.

Furthermore, in the press-fit terminal 1 according to the embodiment as illustrated in FIG. 1, the press-fit portion 13 is formed in a dimension in the width direction Y that is larger than the total dimension (deformed amount in the width direction Y of the press-fit portion 13) of the maximum deformed amount in the width direction Y toward the slit 15 of both contact portions 25 press-fitted into the through hole 11, or larger than the hole diameter of the through hole 11.

Hence, even when the press-fit portion 13 is deformed by press-fitting into the through hole 11, it is possible to cause the contact portion 25 of the press-fit portion 13 protruded outward in the width direction in comparison with the other part of the press-fit portion 13 to reliably come into contact with the inner wall of the through hole 11.

That is, when the press-fit portion 13 is press-fitted into the through hole 11 to a depth such that the part of the press-fit portion 13 where the slit 15 is formed is positioned inside the through hole 11, the contact portion 25 of the press-fit portion 13 positioned on the imaginary line Z in the width direction Y passing through the center in the longitudinal direction of the slit 15 comes into contact with the inner wall of the through hole 11 in the vicinity of the center of the through hole 11 in the press-fit direction X.

For this reason, even when the press-fit depth of the press-fit portion 13 with respect to the through hole 11 of the circuit board 9 varies, the position of the contact portion 25 of the press-fit portion 13 to come into contact with the inner wall of the through hole 11 is displaced only slightly to one of a shallower position and a deeper position which interpose the center of the through hole 11 in the press-fit direction X, and it is possible to prevent displacement of the position of the contact portion 25 of the press-fit portion 13 to a position outside the through hole 11.

Hence, even if the press-fit depth of the press-fit portion 13 with respect to the through hole 11 of the circuit board 9 varies, it is possible to reliably cause the press-fit portion 13 to come into contact with the inner wall of the through hole 11, to obtain a state where the press-fit portion 13 is stably retained in the through hole 11, and to realize reliable electrical connection between the press-fit portion 13 and the through hole 11.

Figure 5:
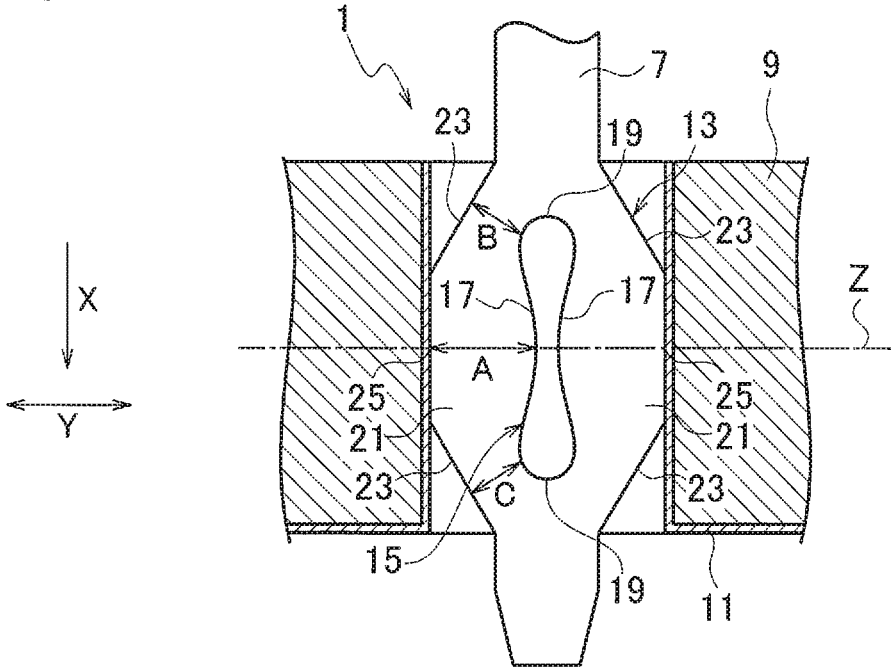
FIG. 5 is an explanatory drawing illustrating an example of a contact state of a press-fit portion with a through hole when press-fitting the press-fit terminal according to the embodiment into a through hole of a circuit board.

Moreover, in the press-fit terminal 1 according to the embodiment as illustrated in FIG. 1, a part of the contact portion 25 on the imaginary line Z where the dimension in the width direction Y of the swelling portion 21 of the press-fit portion 13 becomes largest is deformed most in the width direction Y when press-fitted into the through hole 11 as with the circuit board connection structure of the press-fit terminal as illustrated in FIG. 5. Accordingly, parts on both sides in the press-fit direction X, which interpose the contact portion 25, of the outer edge of the press-fit portion 13 come into contact with the inner wall of the through hole 11.

For this reason, the outer edge of the press-fit portion 13 is caused to continuously come into contact with the inner wall of the through hole 11 over a certain length in the press-fit direction X, so that the press-fit terminal 1 and the through hole 11 come into contact in a certain area or more and the contact resistance therebetween is reduced, and it is possible to ensure electrical connection between the press-fit terminal 1 and the through hole 11.

Figure 6:
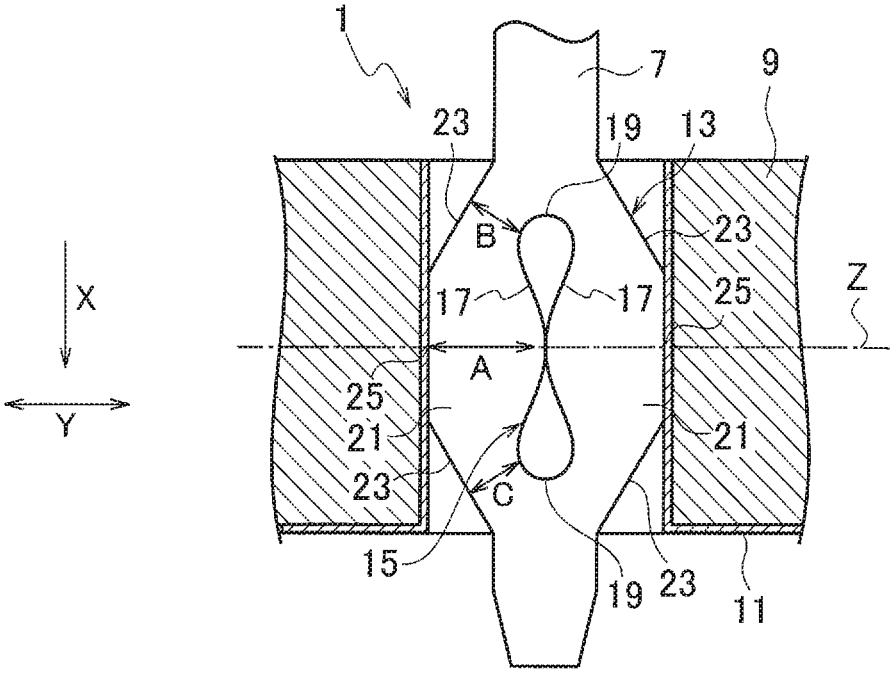
FIG. 6 is an explanatory drawing illustrating an example of a contact state of a press-fit portion with a through hole when press-fitting the press-fit terminal according to the embodiment into a through hole of a circuit board.

The press-fit portion 13 of the press-fit terminal 1 may have a shape such that both linear portions 17 of the slit 15 come into contact directly on the imaginary line Z in a state where the press-fit portion 13 is press-fitted into the through hole 11 as with the circuit board connection structure of the press-fit terminal as illustrated in FIG. 6.

Figure 7:
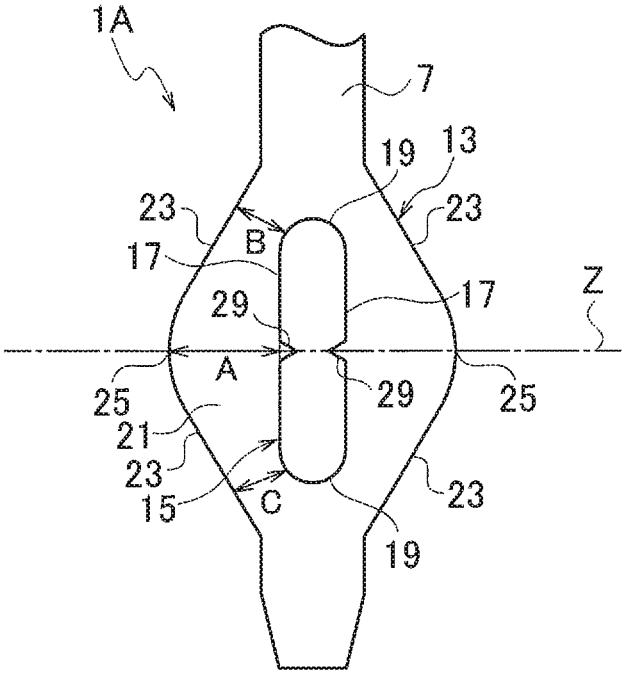
FIG. 7 is an explanatory drawing illustrating a principal part of a press-fit terminal according to a first modification.
Figure 8:
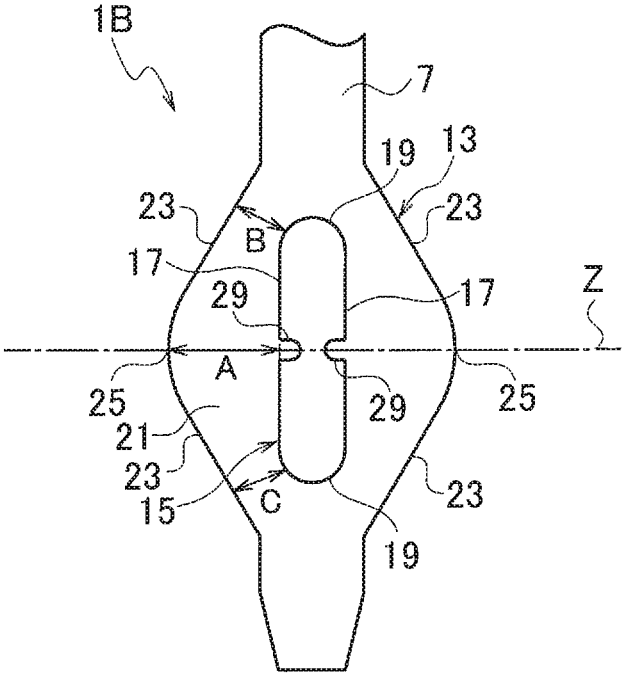
FIG. 8 is an explanatory drawing illustrating a principal part of a press-fit terminal according to a second modification.

Moreover, as with a press-fit terminal 1A according to a first modification as illustrated in FIG. 7 or a press-fit terminal 1B according to a second modification as illustrated in FIG. 8, a projection 29 may be formed at each of the linear portions 17, which is positioned on the imaginary line Z of the slit 15, toward the inner side of the slit 15, so that projections 29 of both linear portions 17 come into contact with each other in a state where the press-fit portion 13 is press-fitted into the through hole 11.

With such a structure, each linear portion 17 or each projection 29 of the slit 15, which is in contact on the imaginary line Z in a state where the press-fit portion 13 is press-fitted into the through hole 11, receives reaction force from the linear portion 17 side of the contact partner. Then, the reaction force becomes stress and is transmitted to the contact portion 25 of the press-fit portion 13 or to parts on both sides in the press-fit direction X, and the contact pressure of these parts against the inner wall of the through hole 11 increases.

Accordingly, it is possible to cause the through hole 11 to stably retain the press-fit portion 13 press-fitted into the through hole 11.

Figure 9:
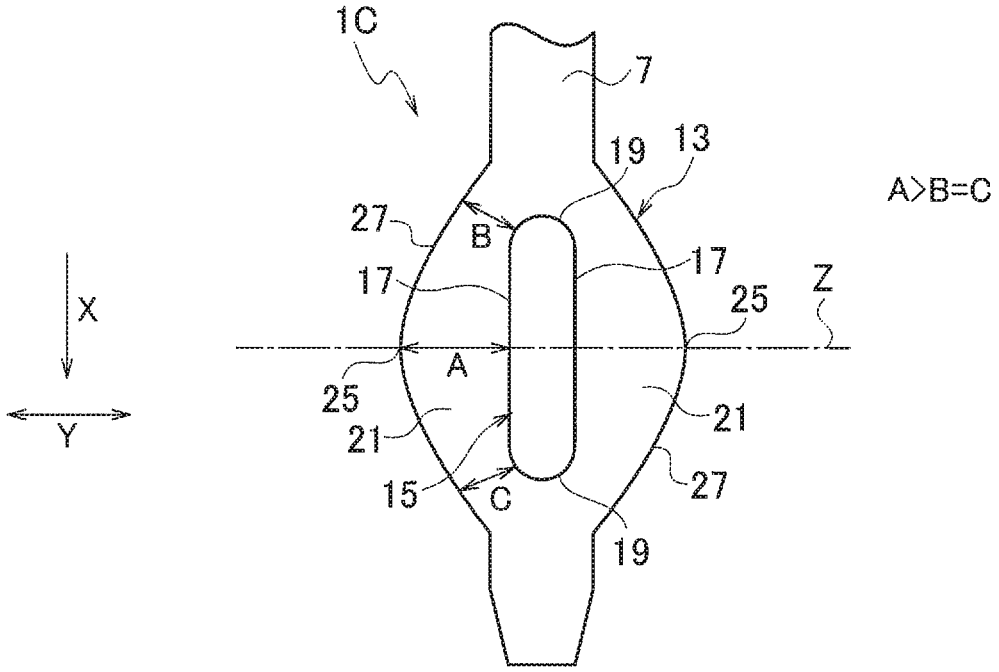
FIG. 9 is an explanatory drawing illustrating a principal part of a press-fit terminal according to a third modification.

Furthermore, the contour of each of the swelling portions 21 of the press-fit portion 13 may be constituted of one circular arc portion 27, for example, as with a press-fit terminal 1C according to a third modification as illustrated in FIG. 9. In such a case, the contact portion 25 of each of the swelling portions 21 can be constituted of a part swelling most outward in the width direction Y positioned on the imaginary line Z of the circular arc portion 27.

However, when each of the swelling portions 21 is constituted of two linear portions 23 and a contact portion 25 therebetween as with the press-fit terminal 1 according to the embodiment as illustrated in FIG. 1, it is possible to easily realize a press-fit portion 13 in which the contact portion 25 is easily deformed into a shape protruded most outward in the width direction Y when press-fitted into the through hole 11 by forming the press-fit portion 13 as a structure such that the rigidity is lowered with the larger distance from the contact portion 25 in the press-fit direction X.

Figure 10:
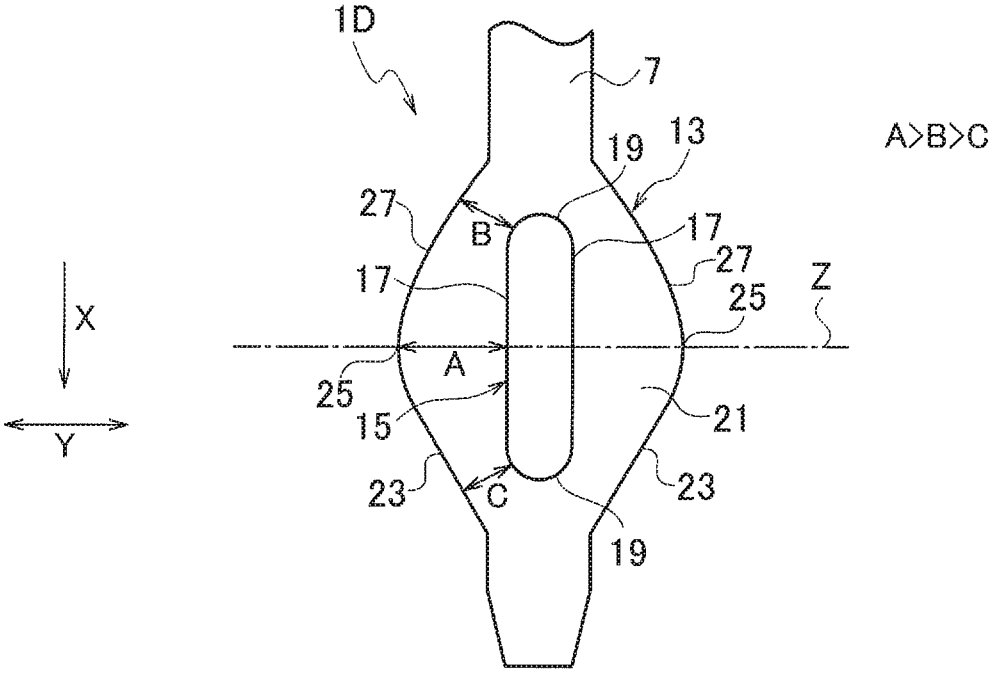
FIG. 10 is an explanatory drawing illustrating a principal part of a press-fit terminal according to a fourth modification.

Moreover, as the contour of each swelling portion 21 of the press-fit portion 13, for example, only the tip side of the terminal pin 7 with respect to the contact portion 25 may be constituted of the linear portion 23, and a part from the contact portion 25 to the base side of the terminal pin 7 may be constituted of one circular are portion 27 as with a press-fit terminal 1D according to a fourth modification as illustrated in FIG. 10.

Figure 11:
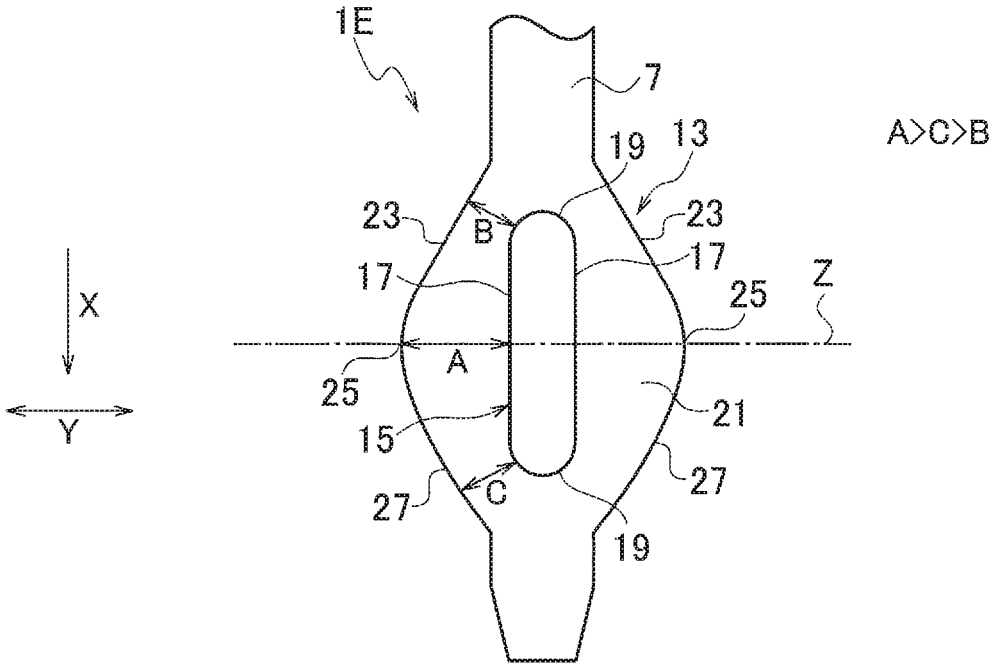
FIG. 11 is an explanatory drawing illustrating a principal part of a press-fit terminal according to a fifth modification.

On the contrary, as the contour of each swelling portion 21 of the press-fit portion 13, for example, only the base side of the terminal pin 7 with respect to the contact portion 25 may be constituted of the linear portion 23, and a part from the contact portion 25 to the tip side of the terminal pin 7 may be constituted of one circular arc portion 27 as with a press-fit terminal 1E according to a fifth modification as illustrated in FIG. 11.

In the press-fit terminal 1D according to the fourth modification as illustrated in FIG. 10, the shortest distance C from the contour of the press-fit portion 13 to the slit 15 becomes the minimum dimension (B>C) at an end portion of the slit 15 on the tip side of the terminal pin 7 in the press-fit direction X where the contour of the swelling portion 21 is constituted of the linear portion 23.

On the other hand, in the press-fit terminal 1E according to the fifth modification as illustrated in FIG. 11, the shortest distance B from the contour of the press-fit portion 13 to the slit 15 becomes the minimum dimension (B<C) at an end portion of the slit 15 on the base side of the terminal pin 7 in the press-fit direction X where the contour of the swelling portion 21 is constituted of the linear portion 23.

In addition, in the press-fit terminal 1D according to the fourth modification and the press-fit terminal 1E according to the fifth modification, the press-fit portion 13 is deformed most toward the slit 15 by the stress from the inner wall of the through hole 11 in a part where the shortest distances B and C from the contour of the press-fit portion 13 to the slit 15 become the minimum dimension when press-fitted into the through hole 11.

For this reason, in the press-fit terminal 1D according to the fourth modification, the contact pressure of the contact portion 25 of the press-fit portion 13 against the inner wall of the through hole 11 is increased, and the press-fit portion 13 is stably retained in the through hole 11 so that the anchoring effect can be enhanced. On the other hand, in the press-fit terminal 1E according to the fifth modification, it is possible to reduce the insertion force required when press-fitting the press-fit portion 13 into the through hole 11.

Figure 12:
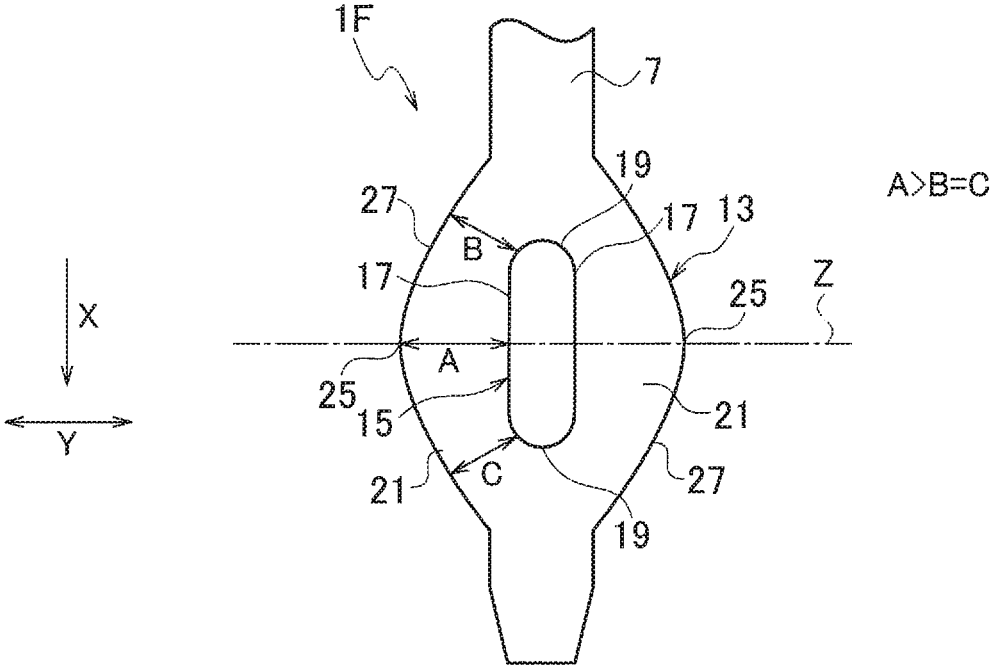
FIG. 12 is an explanatory drawing illustrating a principal part of a press-fit terminal according to a sixth modification.

Furthermore, the slit 15 of the press-fit portion 13 may, for example, have a dimension shorter in the press-fit direction X than the slit 15 of the press-fit terminal 1C according to the third modification as with a press-fit terminal 1F according to a sixth modification as illustrated in FIG. 12.

Figure 13:
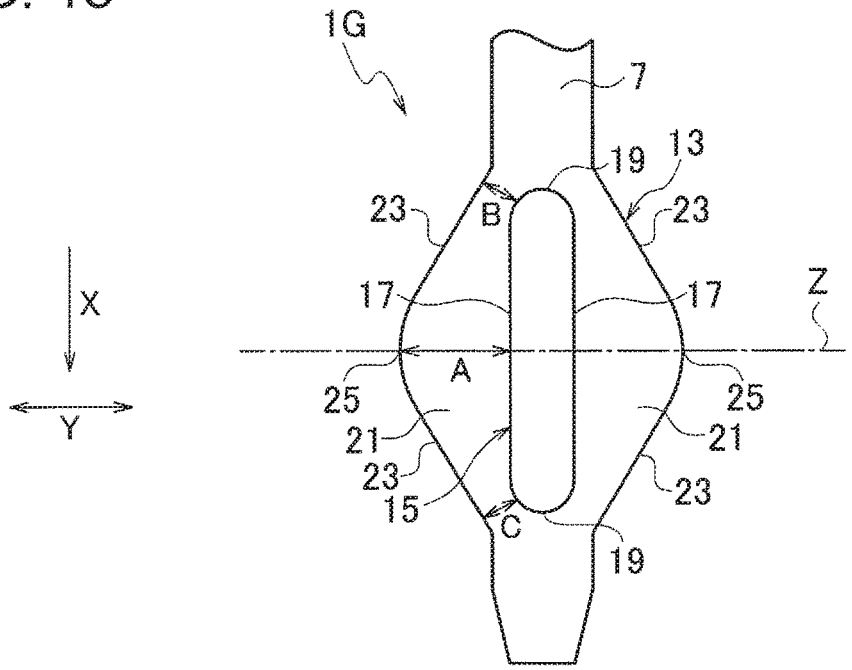
FIG. 13 is an explanatory drawing illustrating a principal part of a press-fit terminal according to a seventh modification.

On the contrary, the slit 15 of the press-fit portion 13 may have, for example, a dimension longer in the press-fit direction X than the slit 15 of the press-fit terminal 1 according to the embodiment as with a press-fit terminal 1G according to a seventh modification illustrated in FIG. 13. It is clear that the dimension of the slit 15 of the press-fit terminal 1A according to the first modification may be changed into a longer dimension in the press-fit direction X.

In any case, however, the slit 15 needs to have a dimension in the press-fit direction X such that the shortest distance A from the contour of the press-fit portion 13 to the slit 15 in the part of the contact portion 25 becomes larger than the shortest distances B and C from the contour of the press-fit portion 13 to the slit 15 in the part of the linear portion 23.

Moreover, in the press-fit terminals 1, 1A, 1B, 1D, and 1E according to the embodiment, the first modification, the second modification, the fourth modification, and the fifth modification, the dimension in the press-fit direction X of the slit 15 may be short as with the press-fit terminal 1F according to the sixth modification.

Similarly, regarding the press-fit terminals 1A to 1E according to the embodiment and the first modification to the fifth modification, the dimension in the press-fit direction X of the slit 15 may be long as with the press-fit terminal 1G according to the seventh modification.

When the press-fit portion 13 of the press-fit terminal 1 is press-fitted into the through hole 11, the press-fit portion 13 is deformed toward the inner side of the slit 15 in the width direction Y in a part overlapping with each linear portion 17 of the slit 15 in the press-fit direction X. On the other hand, the press-fit portion 13 is not substantially deformed toward the inner side of the slit 15 in the width direction Y in a part overlapping with each semicircular portion 19 of the slit 15 in the press-fit direction X.

Figure 14:
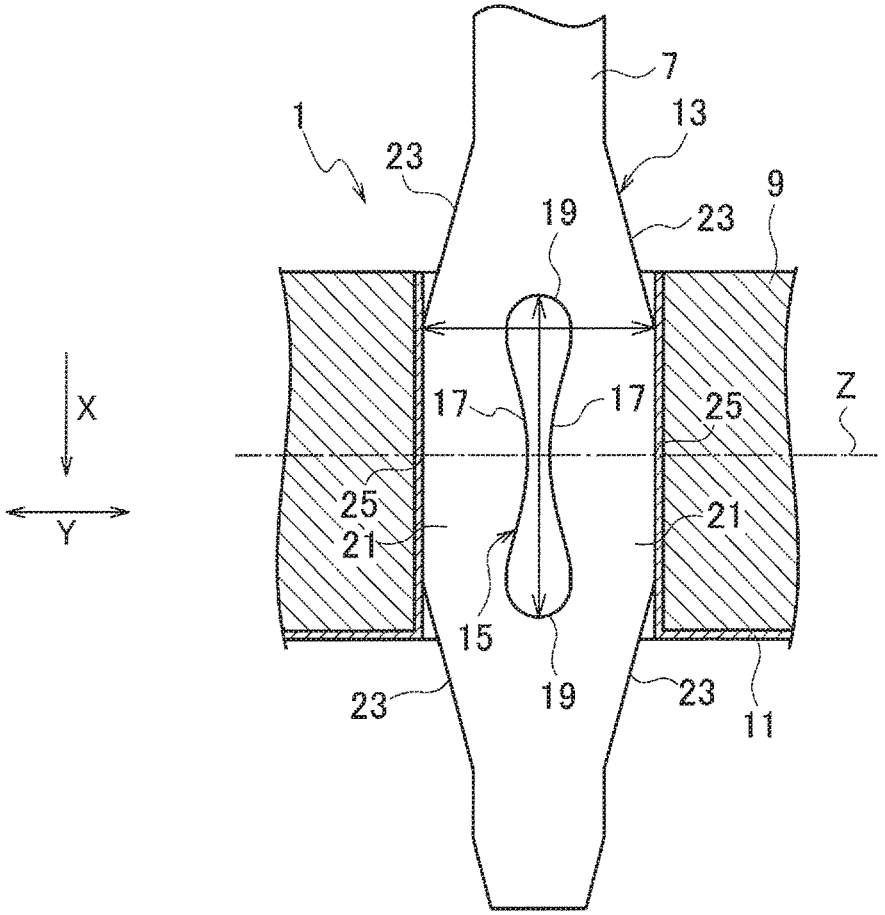
FIG. 14 is an explanatory drawing illustrating an example of the positional relation between both ends of a slit and a through hole in the press-fit direction of a press-fit terminal connection structure of a circuit board according to the embodiment.

For this reason, when the press-fit portion 13 of the press-fit terminal 1 is press-fitted into the through hole 11, large reaction force is applied from the press-fit portion 13 to the circuit board 9 in a case where the part of each semicircular portion 19 of the slit 15 overlaps with a part of the press-fit portion 13 to come into contact with the inner wall of the through hole 11 in the press-fit direction X as illustrated in FIG. 14.

That is, a part of the press-fit portion 13 which is not substantially deformed in the width direction Y comes into contact with the inner wall of the through hole 11, and reaction force corresponding to the stress applied from the inner wall of the through hole 11 is applied to the circuit board 9 via the inner wall of the through hole 11 substantially without being attenuated by deformation in the width direction Y of the press-fit portion 13.

Figure 15:
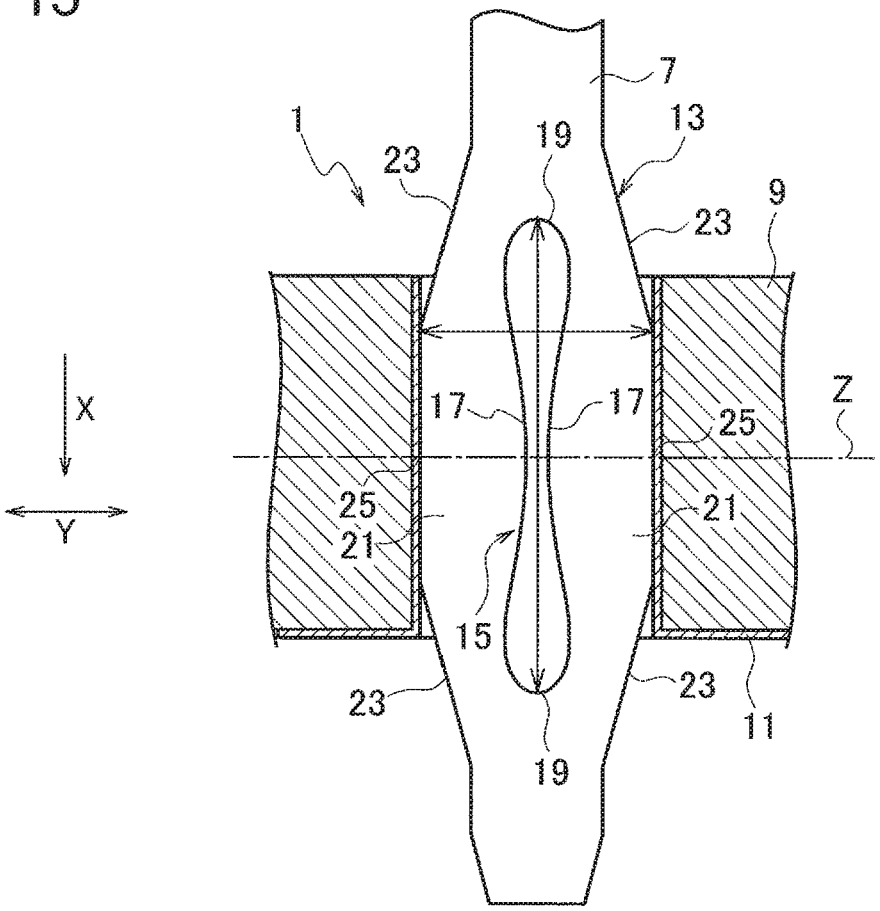
FIG. 15 is an explanatory drawing illustrating an example of the positional relation between both ends of a slit and a through hole in the press-fit direction of a press-fit terminal connection structure of a circuit board according to the embodiment.

Therefore, as illustrated in FIG. 15, the slit 15 may be formed in such a manner that a part of each semicircular portion 19 is positioned outside the through hole 11 of the circuit board 9, so as not to overlap in the press-fit direction X with a part of the press-fit portion 13 to come into contact with the inner wall of the through hole 11 when the press-fit portion 13 of the press-fit terminal 1 is press-fitted into the through hole 11.

As a result, a part of the press-fit portion 13 which is not substantially deformed in the width direction Y does not come into contact with the inner wall of the through hole 11, and reaction force corresponding to stress applied from the inner wall of the through hole 11, which is not substantially attenuated by deformation in the width direction Y of the press-fit portion 13, is not applied to the circuit board 9, and therefore it is possible to reduce damage to the circuit board 9 from the press-fit terminal 1 of the through hole 11.

Figure 16:
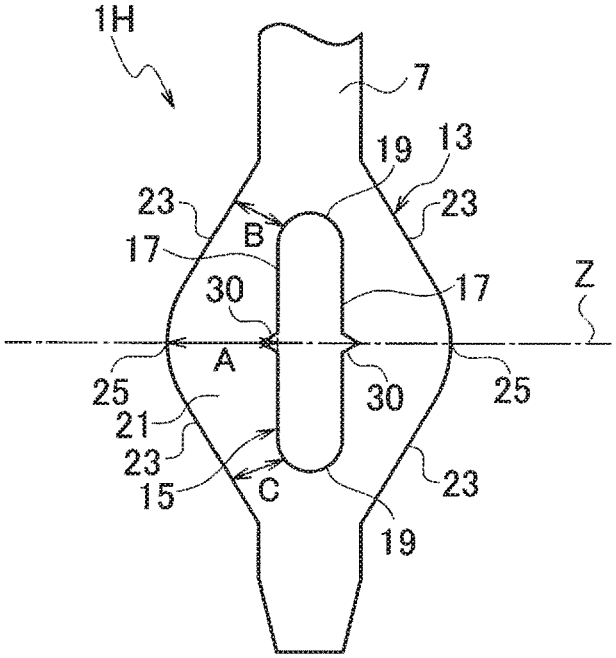
FIG. 16 is an explanatory drawing illustrating a principal part of a press-fit terminal according to an eighth modification.
Figure 17:
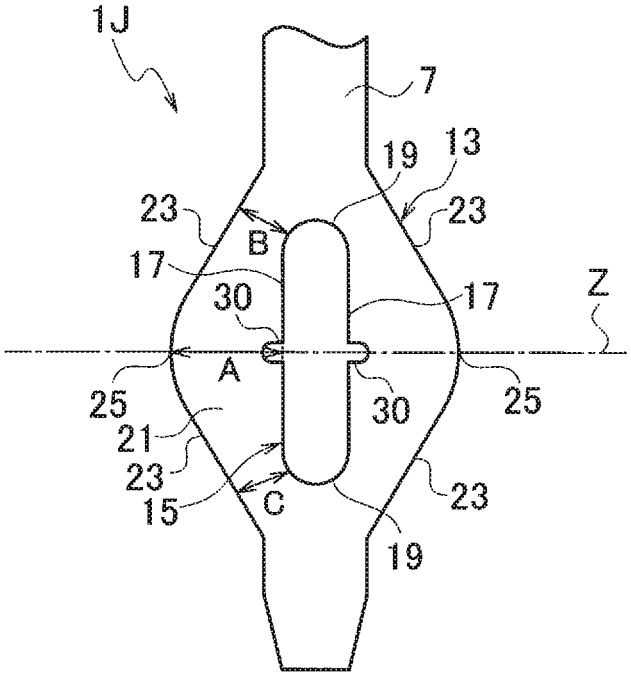
FIG. 17 is an explanatory drawing illustrating a principal part of a press-fit terminal according to a ninth modification.

Furthermore, in order to further facilitate deformation when press-fitted into the through hole 11, a notch 30 toward the contact portion 25 may be formed at the linear portion 17 positioned on the imaginary line Z of the slit 15 of the press-fit portion 13 of the press-fit terminal 1 according to the embodiment illustrated in FIG. 1 as with a press-fit terminal 1H according to an eighth modification as illustrated in FIG. 16, or a press-fit terminal 1J according to a ninth modification as illustrated in FIG. 17.

Figure 18:
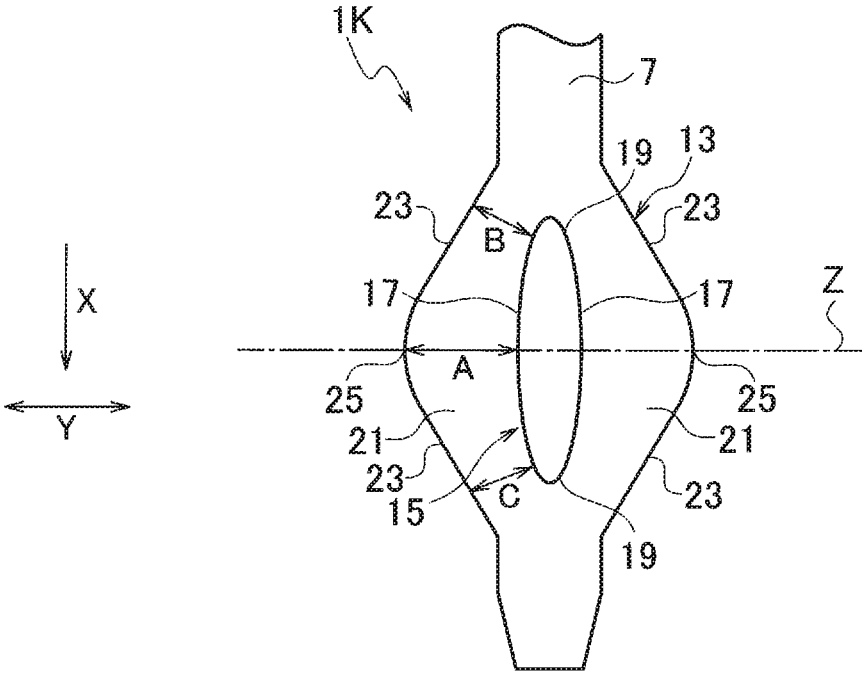
FIG. 18 is an explanatory drawing illustrating a principal part of a press-fit terminal according to a tenth modification.

Moreover, the slit 15 of the press-fit portion 13 may have an elliptical shape having a major axis direction matched with the press-fit direction X as with a press-fit terminal 1K according to a tenth modification illustrated in FIG. 18.

In such a case, however, the slit 15 also needs to have a dimension in the press-fit direction X such that the shortest distance A from the contour of the press-fit portion 13 to the slit 15 in the part of the contact portion 25 becomes larger than the shortest distances B and C from the contour of the press-fit portion 13 to the slit 15 in the part of the linear portion 23.

Figure 19:
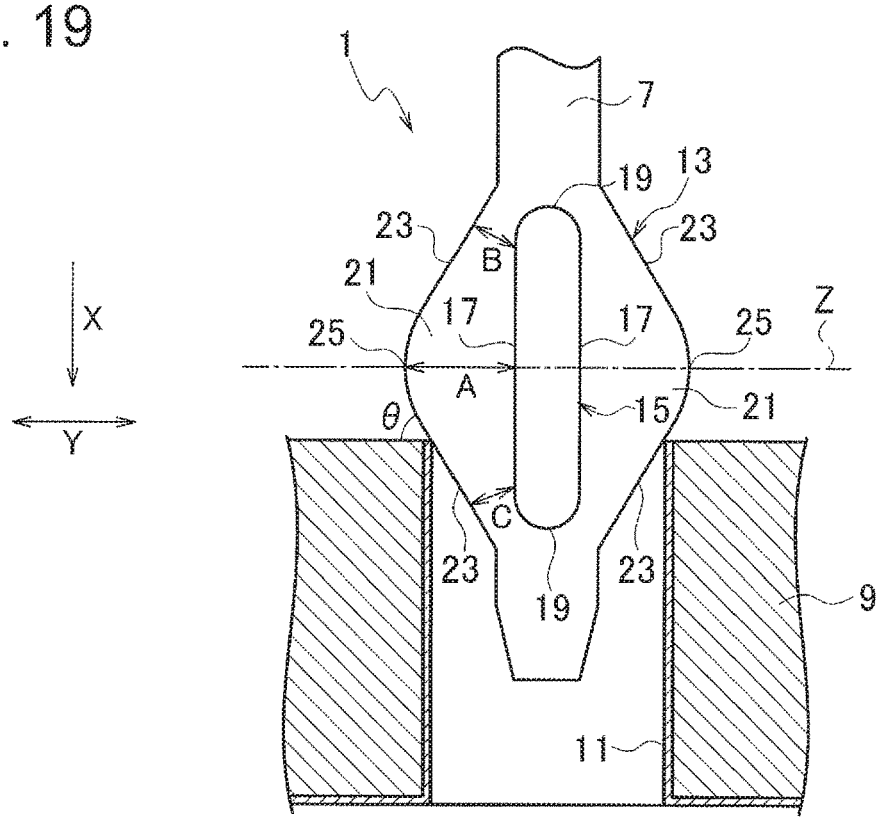
FIG. 19 is an explanatory drawing illustrating an example of a state where a press-fit portion of a press-fit terminal according to the embodiment is press-fitted into a through hole of a circuit board.

When the press-fit portion 13 of the press-fit terminal 1 according to the embodiment illustrated in FIG. 1 is press-fitted into the through hole 11, the larger the angle θ between the surface of the circuit board 9 and the linear portion 23 of the press-fit portion 13 is, the larger the stress (force required to insert the press-fit portion 13) which the press-fit portion 13 receives from the through hole 11 is as illustrated in FIG. 19.

Figure 20:
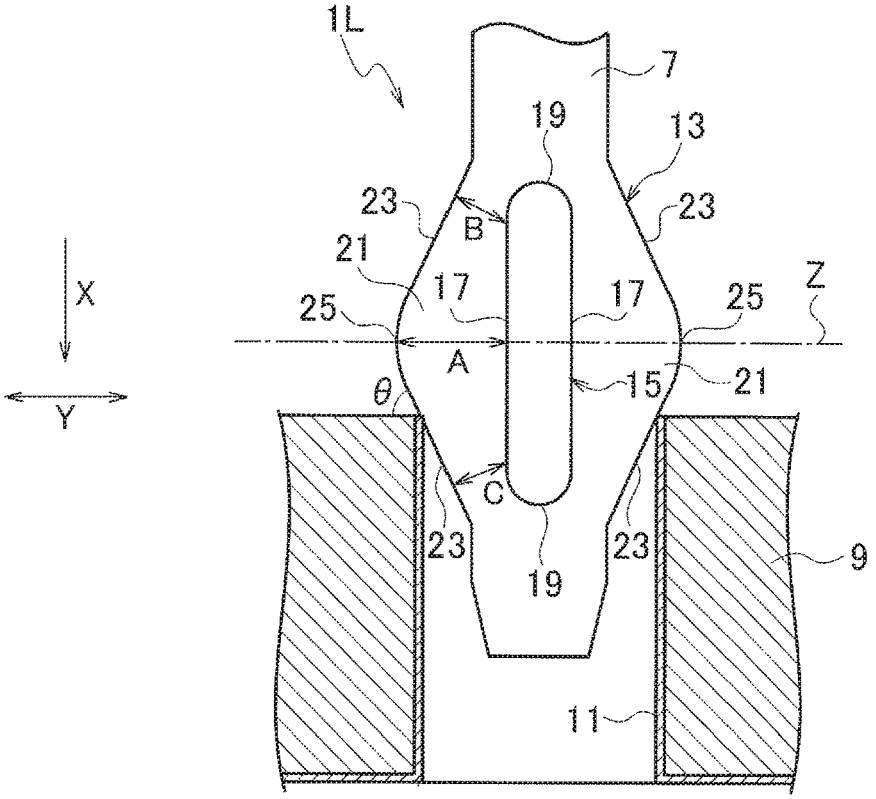
FIG. 20 is an explanatory drawing illustrating an example of a state where a press-fit portion of a press-fit terminal according to the embodiment is press-fitted into a through hole of a circuit board.

Therefore, in order to make the angle θ between the surface of the circuit board 9 and the linear portion 23 of the press-fit portion 13 small as in the press-fit terminal 1L according to the eleventh modification as illustrated in FIG. 20, the dimension in the width direction Y of the terminal pin 7 may be larger than the press-fit terminal 1 according to the embodiment.

Moreover, regarding the press-fit terminals 1A to 1E according to the first modification to the fifth modification, the dimension in the width direction Y of the terminal pin 7 may be increased so that the angle θ between the surface of the circuit board 9 and the swelling portion 21 of the press-fit portion 13 when press-fitting the press-fit portion 13 into the through hole 11 is made small as with the press-fit terminal 1L according to the eleventh modification.

Figure 21:
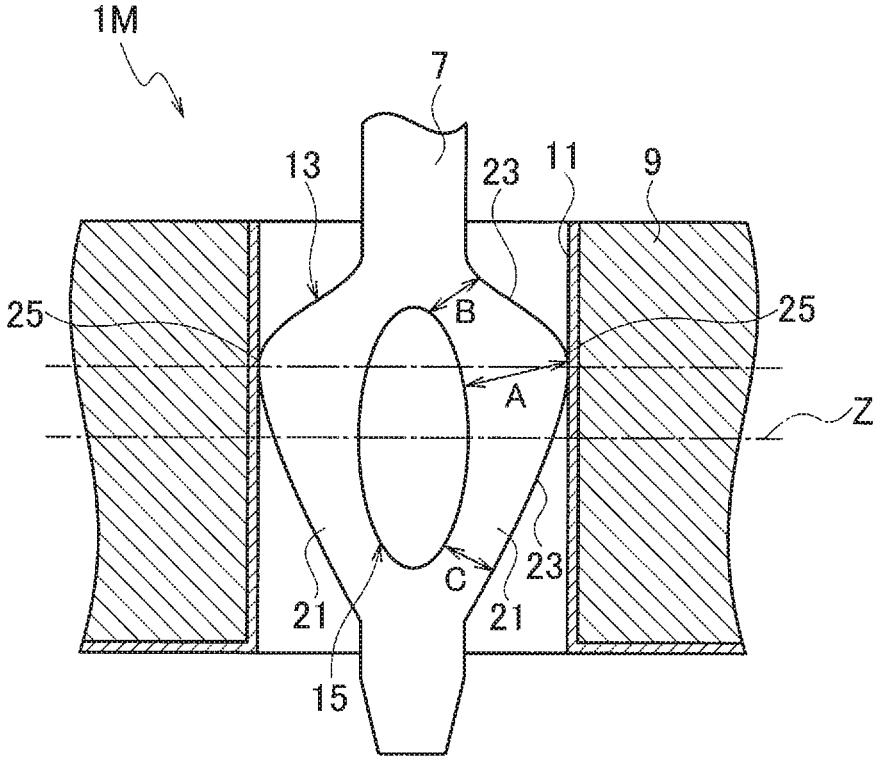
FIG. 21 is an explanatory drawing illustrating a principal part of a press-fit terminal according to a reference example.

In a press-fit terminal 1M according to a reference example as illustrated in FIG. 21, the position of the contact portion 25 of the press-fit portion 13 is displaced from the imaginary line Z in the width direction Y passing through the center in the press-fit direction X of the slit 15 to the base side of the terminal pin 7 in the press-fit direction X. Moreover, the slit 15 is formed in an elliptical shape having a major axis direction matched with the press-fit direction X.

In the press-fit terminal 1M according to the reference example, the shortest distance A from the contour of the press-fit portion 13 to the slit 15 in the part of the contact portion 25 is made larger than the distances B and C from the contour of the press-fit portion 13 to the slit 15 in the part of the linear portion 23.

In the press-fit terminal 1M according to the reference example having such a structure, the contour of the press-fit portion 13 has a small inclination with respect to the press-fit direction X on the tip side of the terminal pin 7 with respect to the contact portion 25, and has a large inclination with respect to the press-fit direction X on the base side of the terminal pin 7 with respect to the contact portion 25.

For this reason, even when the press-fit portion 13 is deformed by press-fitting into the through hole 11, the contact portion 25 of the press-fit portion 13 is hardly deformed in the width direction Y toward the slit 15, so that the contact portion 25 reliably comes into contact with the inner wall of the through hole 11.

Moreover, since the inclination of the contour of the press-fit portion 13 with respect to the press-fit direction X is made small on the tip side of the terminal pin 7 with respect to the contact portion 25, the insertion force required for press-fitting the press-fit portion 13 into the through hole 11 can be reduced.

Furthermore, since the inclination of the contour of the press-fit portion 13 with respect to the press-fit direction X is made large on the base side of the terminal pin 7 with respect to the contact portion 25, the press-fit portion 13 press-fitted into the through hole 11 is stably retained, and the anchoring effect can be enhanced.

In the press-fit terminals 1 to 1L and 41 according to the embodiment and modifications thereof described with reference to FIGS. 1 to 20 (except FIGS. 3A and 3B), the dimensions of the press-fit portions 13 and 43 in the width direction Y become largest at the contact portions 25 and 47 on the imaginary line Z passing through the center of the slit 15 in the press-fit direction X.

However, places where the dimensions in the width direction Y of the press-fit portions 13 and 43 become largest may be places displaced in the press-fit direction X from the positions of the contact portions 25 and 47.

Moreover, in the press-fit terminals 1 to 1L and 41 according to the embodiment and modifications thereof, the dimensions of the contact portions 25 and 47 in the width direction Y of the press-fit portions 13 and 43 before insertion into the through hole 11 are set to dimensions obtained by adding the maximum deformed amounts of the contact portions 25 and 47 in the width direction Y and the hole diameter of the through hole 11.

However, the dimensions of the contact portions 25 and 47 in the width direction Y of the press-fit portions 13 and 43 before insertion into the through hole 11 may be set to dimensions obtained by adding the hole diameter of the through hole 11 and deformed amounts smaller than the maximum deformed amounts of the contact portions 25 and 47 in the width direction Y.

What is claimed is:

1. A press-fit terminal, comprising:

a press-fit portion that is deformed in a width direction orthogonal to a press-fit direction into a through hole of a circuit board when the press-fit portion is press-fitted into the through hole;

a slit that is formed in the press-fit portion and has a longitudinal direction matched with the press-fit direction into the through hole, the slit comprising two first linear portions extending in parallel and spaced at an interval in the width direction; and a contact portion, which is formed in a part on an imaginary line passing through a center of the slit in the longitudinal direction and extending in the width direction in the press-fit portion and comes into contact with an inner wall of the through hole by press-fitting the press-fit portion into the through hole, a shortest distance from a contour of the press-fit portion to the slit becoming largest in the contact portion, wherein, each first linear portion of the two first linear portions comprises a notch formed on the imaginary line such that the notches facilitate deformation of the press-fit terminal by pressing the press-fit portion into the through hole.

2. The press-fit terminal according to claim 1, wherein the contact portion is formed in a shape such that a difference obtained by subtracting a hole diameter of the through hole from a dimension in the width direction of the press-fit portion before press-fitting into the through hole becomes a maximum deformed amount in the width direction of the press-fit portion toward the slit by press-fitting into the through hole.

3. The press-fit terminal according to claim 1, wherein the press-fit portion is formed with a contour such that the shortest distance to the slit becomes smallest at both ends in the longitudinal direction of the slit.

4. The press-fit terminal according to claim 1, wherein the press-fit portion is formed with a contour such that a dimension in the width direction becomes largest in the contact portion.

5. The press-fit terminal according to claim 1, further comprising a second linear portion, which is formed in a part continuous with the contact portion in the press-fit direction of the press-fit portion and has a dimension in the width direction that linearly decreases with a larger distance from the imaginary line in the press-fit direction, wherein the contact portion is formed with a contour of a convex circular arc toward a side away from the slit.

6. A press-fit terminal connection structure of a circuit board, comprising:

a circuit board on which a through hole is formed; and a press-fit terminal press-fitted into the through hole, the press-fit terminal comprising:

a press-fit portion that is deformed in a width direction orthogonal to a press-fit direction into the through hole when the press-fit portion is press-fitted into the through hole;

a slit that is formed in the press-fit portion and has a longitudinal direction matched with the press-fit direction into the through hole, the slit comprising two first linear portions extending in parallel and spaced at an interval in the width direction; and a contact portion, which is formed in a part on an imaginary line passing through a center of the slit in the longitudinal direction and extending in the width direction in the press-fit portion and comes into contact with an inner wall of the through hole, a shortest distance from a contour of the press-fit portion to the slit becoming largest in the contact portion, wherein, each first linear portion of the two first linear portions comprises a notch formed on the imaginary line such that the notches facilitate deformation of the press-fit terminal by pressing the press-fit portion into the through hole.

* * * * *